United States Patent [19]

Eastman, II et al.

[11] Patent Number: 4,557,243

[45] Date of Patent: Dec. 10, 1985

[54] ARROW GAME TRACKER

[76] Inventors: Robert E. Eastman, II, 1232 Briarcliffe, Flint, Mich. 48504; Dale W. Gray, 3171 W. Reid Rd., Swartz Creek, Mich. 48473

[21] Appl. No.: 44,936

[22] Filed: Jun. 4, 1979

[51] Int. Cl.[4] ..... F41B 5/00

[52] U.S. Cl. ..... 124/88; 124/24 R

[58] Field of Search ..... 124/88, 24 R, 23 R, 124/25, 23, 80; 273/106.5 B; 242/55.53, 84.1 R, 84.1 K, 129, 137.1, 146; 43/6

[56] References Cited

U.S. PATENT DOCUMENTS

| | | | |
|---|---|---|---|
| 441,454 | 11/1890 | Vileyn | 242/129 |
| 2,568,279 | 9/1951 | Franz et al. | 273/DIG. 24 |
| 2,812,756 | 11/1957 | Myers | 124/23 R |
| 3,059,370 | 10/1962 | Moore | 124/23 R X |
| 3,227,454 | 1/1966 | Ellenburg | 43/6 X |
| 3,419,991 | 1/1969 | Mitchell | 43/6 |
| 3,910,579 | 10/1975 | Sprandel | 273/106.5 B |
| 3,949,730 | 4/1976 | Schoenberger | 124/24 R |
| 4,309,974 | 1/1982 | Carter et al. | 124/23 R |

FOREIGN PATENT DOCUMENTS

| | | | |
|---|---|---|---|
| 583045 | 7/1959 | Canada | 124/80 |
| 917311 | of 1946 | France | 43/6 |
| 413030 | of 1946 | Italy | 124/80 |

*Primary Examiner*—Richard J. Apley
*Assistant Examiner*—William R. Browne
*Attorney, Agent, or Firm*—Basile, Weintraub & Hanlon

[57] ABSTRACT

A game tracking device for use in combination with a bow and arrow comprises a tracking line, a canister and a mounting bracket. The canister is mounted to the bow by means of the mounting bracket which is configured to mount the canister at a point laterally removed from the bow. The tracking line is center wound and stored within the canister and is secured at a free end thereof, to an arrow. In this manner, when the arrow is launched, the tracking line is paid out of the canister to track the position of the arrow. An arrow is disclosed herein which is adapted to receive securely the free end of the tracking line.

3 Claims, 3 Drawing Figures

ARROW GAME TRACKER

BACKGROUND OF THE INVENTION

I. Field of the Invention

The present invention pertains to game tracking devices. More particularly, the present invention pertains to game tracking devices for use in combination with archery equipment. Even more particularly, the present invention pertains to game tracking devices for tracking the position of an arrow which has been launched from the bow.

II. Description of the Prior Art

Game tracking devices for use in combination with archery equipment generally comprise a tracking line which is coupled with an arrow and paid out from the bow. In game tracking devices of the prior art, the tracking line is generally wound about a fixed point or is wound about a reel or other mechanical pay out device associated with the bow. The pay out devices of the prior art are generally mounted directly to the bow and proximate its center so as not to disturb its balance. However, placement of the pay out device proximate the mid point of the bow can interfere with the aim and launching of the arrow. Moreover, devices, such as reels, are susceptible to mechanical difficulties which could cause the line to stick and thereby inhibit the movement of the string and, thus, the arrow.

Further, tracking lines of the prior art are secured to the arrow by tying or by threading the line through the entire body of the arrow. Tying the line to an arrow can damage the weighting of an arrow and lines so secured are susceptible to slipping. Moreover, knots and excess lines can interfere with the handling and aiming of the arrow. Threading the line through the arrow eliminates these problems but is a complicated and time consuming procedure.

Thus, substantial benefits would be achieved by providing a tracking device for a bow and arrow wherein a tracking line is paid out non-mechanically.

Further benefits would be achieved by providing a pay out device for a tracking line which is mounted to a bow proximate its mid point to preserve its balance and weighting, but laterally removed therefrom to avoid interferance with aim and handling of the arrows.

Further benefits would be obtained by providing an arrow which is adapted to receive and secure a tracking line.

SUMMARY OF THE INVENTION

According to the present invention there is provided a game tracking device for use in combination with a bow and arrow. The tracking device comprises a tracking line which is paid out from a container mounted to the bow and which is secured at a free end to an arrow.

The container hereof is mounted to the bow by means of a mounting bracket which is configured to mount the container to the bow at a point laterally removed therefrom. In this manner, the container may be mounted proximate the mid point of the bow, preserving balance, without interfering with the aiming or firing of the arrow.

The tracking line is center would within the container and is paid out of the container smoothly without dependence on any mechanical means.

A free end of the tracking line is attached to the arrow. The arrow is provided with a line receiving portion and a detachable portion which is mounted to the arrow to enclose and secure the attached line.

Therefore, it is an object of the present invention to provide a game tracking device for use with a bow and arrow which is mounted to the bow proximate its mid point without interferrance with the aiming or launching of the arrow.

It is a further object of the present invention to provide a game tracking line which is paid out without dependence on mechanical means.

It is a further object of the present invention to provide an arrow having means provided thereon for receiving securely and efficiently, the tracking line hereof.

Further objects and advantages of the present invention will become readily apparent to the skilled artisan when the following detailed description is read in conjunction with the accompanying drawing. In the drawing, like reference numerals refer to like parts throughout the several views in which:

DETAILED DESCRIPTION OF THE PREFERRED EMBODIMENT

Figure 1:
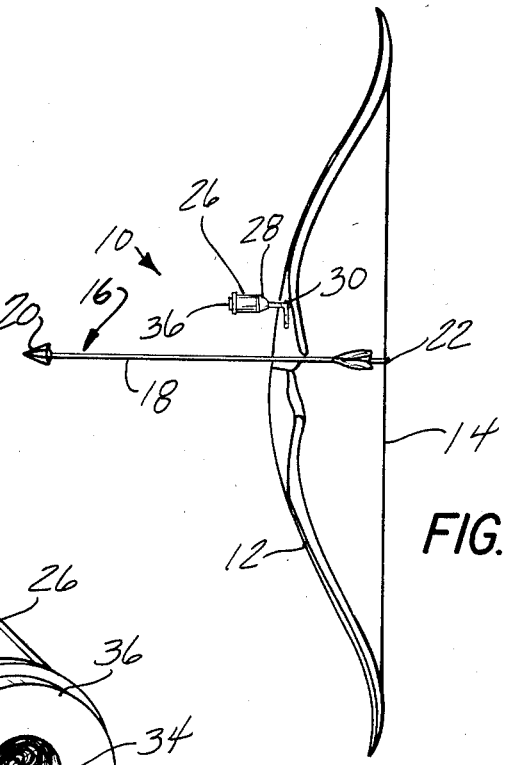
FIG. 1 is a front elevational view of the game tracking device hereof mounted to a bow and arrow.

Now and with reference to FIG. 1 there is depicted generally at 10, the game tracking device hereof, mounted to a bow 12. The bow 12 is provided with a bow string 14, secured tautly thereto, which cooperates with the bow to define a launching device for launching an arrow. An arrow 16 is provided of the type having a shaft 18, a detachably mounted head 20 and an opposite end 22. The arrow 16 is launched by bringing its end 22 into close abutment with the bow string 14, the shaft abutting the side of the bow 12, and then drawing the bow string 14 and the arrow 16 back, away from the bow 12. When the bow string 14 and the arrow 16 are released, the bow string 14 snaps back to its original position, thereby launching the arrow. Generally, the arrow is aimed by holding the bow at arm's length, and at arm's level such that the archer can direct his vision along the line defined by the shaft of the arrow and adjust the position of the arrow in accordance with the target.

It is to be understood that the position of the bow 12 will influence the path of the arrow. Accordingly, the bow 12 is generally balanced such that the weight of the bow above its mid point is approximately equal to that below the mid point, for maximum control of the angular orientation thereof. Accordingly, it is to be understood that objects mounted to the bow should be mounted as close as possible to its mid point to minimize the effect of the additional weight in accordance with established physical principles.

Figure 2:
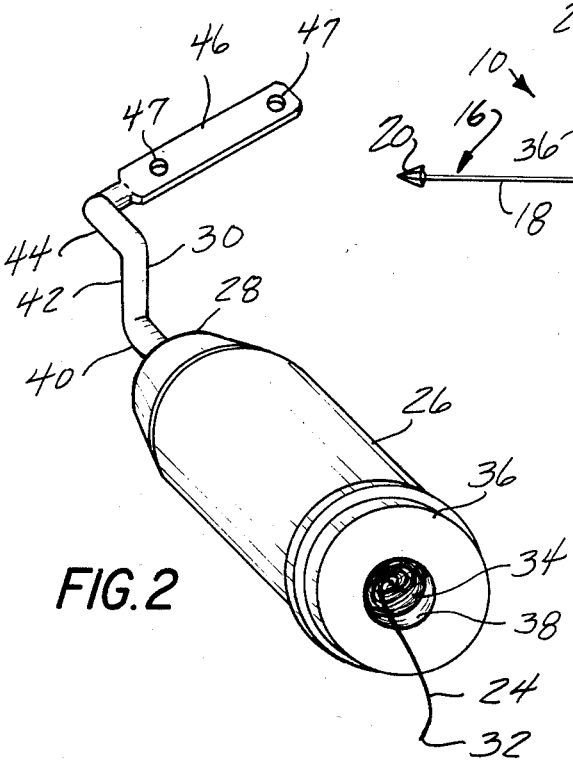
FIG. 2 is a perspective view thereof.

As best seen in FIG. 2, the game tracking device 10 hereof comprises a tracking line 24, a container 26 and a mounting bracket 30. The tracking line 24 is stored within the container 26 which is mounted to the bow 12 by means of the mounting bracket 30.

As illustrated in FIG. 1, a free end 32 of the tracking line 24 is secured to the arrow 16 prior to its launch in a manner that will be described more fully hereinbelow.

Thus, when the arrow is launched, the tracking line 24 is pulled along by the arrow 16, thus drawing the tracking line 24 out of the container 26. In this manner, when the arrow has found its target or has fallen, its location may be tracked by following the tracking line which has been carried along by the arrow.

The tracking line 24 may comprise any suitably durable cord or string. The line 24 may be provided with a luminescent coating to permit the line 24 to glow in the dark. In this manner, arrows can be found even in poor lighting conditions.

The tracking line 24 must be paid out of the container 26 smoothly and easily so as not to inhibit the flight of the arrow. Accordingly, in the preferred embodiment, the tracking line is center wound into a spool 34 such that the line 24 is paid out from the center of the spool 34. In this manner, tangling and other restrictions of the movement of the tracking line 24 are avoided and any restraint of or interference with the flight of the arrow is prevented. Further, a second end (not shown) of the tracking line may be anchored to the container to prevent the entire line 24 from being carried with the arrow.

The container 26 of the preferred embodiment is a generally cylindrical canister, having a first mounting end 28 and an open end (not shown) into which the tracking line 24 is inserted. The open end of the canister 26 is provided with a cover which is configured to fit tightly over the canister to retain the spool 34 therewithin. The cover 36 is provided with an aperture 38 through which the tracking line is paid out. The aperture 38 is sufficiently large so as not to inhibit the movement of the paid out line. However, the diameter of the aperture 38 is smaller than that of the spool 34 to prevent the entire spool from being drawn out of the canister 26. The canister 26 and its cover 36 are provided with complementary interlocking means such as notches and grooves or threadings to permit the cover 36 to be selectively secured to or detached from the canister 26. In this manner, when an arrow has been launched, carrying a tracking line 24 in accordance herewith, a new arrow may be launched quickly and conveniently by removing the cover 36, removing the remains of the spent spool 34 and reloading the canister 26 with a fresh spool of tracking line and replacing the cover 36.

The mounting end 28 of the canister 26 is coupled with the mounting bracket 30. The mounting bracket 30 is configured to mount the canister 26 to the bow 12 such that the open end of the canister faces the direction in which the arrows are launched, and such that the canister 26 is laterally removed from the bow, outside the archer's line of sight. This orientation of the canister, laterally removed from the bow, therefore avoids interference with aiming and handling and the line paid out from the canister will not impede the flight of the arrow.

In the preferred embodiment, the mounting bracket 30 comprises a first mounting leg 40 which is coupled with the mounting end 28 of the canister and second and third legs 42, 44 respectively. The second leg 42 of the bracket 30 is perpendicular to the mounting leg 40 and to the third leg 44. A mounting plate 46 is secured to the third leg 44 and lies in a plane with said third leg 44, perpendicular thereto. The mounting plate 46 is provided with means such as apertures 47 which are adapted to receive mounting devices such as screws for securing the plate 46 to the bow 12.

In this manner when the mounting plate 46 is secured to the bow 12, the angular orientations of the legs 40, 42 and 44 are such that the canister 26 mounted thereto will be positioned laterally to one side of the bow 12, the open end of the canister 26 facing in the direction of the arrow head 20 as shown in FIG. 1.

Figure 3:
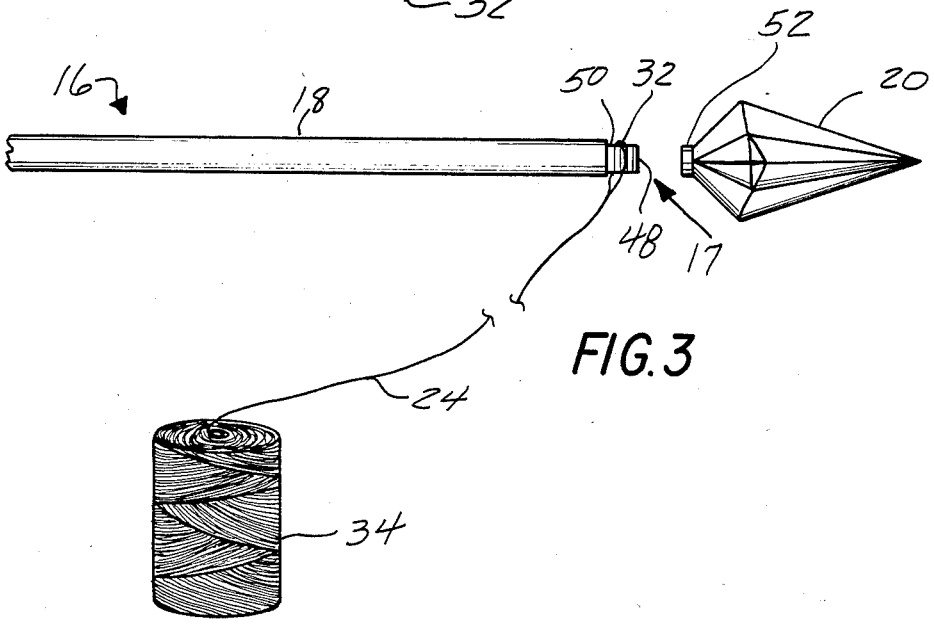
FIG. 3 is an elevational view of an arrow in accordance with the present invention, partially broken away.

With reference to FIGS. 1 and 3, there is depicted therein an arrow 16 constructed in accordance with the present invention. The arrow 16 hereof is provided with means 17 for securing the free end 32 of the tracking line 24 thereto. In the preferred embodiment, the tracking line 24 is secured to the arrow 16 proximate its head 20. The arrow shaft 18 is provided with a reduced diameter portion 48 for mounting the arrow head 20. The reduced diameter portion 48 defines the means 17 for receiving the tracking line 24 and may be provided with threading or notches 50. The arrow head 20 is provided with a neck 52 which is dimensioned to fit snugly over the reduced diameter portion 48 of the shaft 18. The neck 52, in the preferred embodiment, is provided with means such as interior notches or threading which define mounting means complementary to those provided on the reduced diameter portion 48 of the shaft 18 to enable the arrow head 20 to be mounted securely thereon.

As best seen in FIG. 3, in the preferred embodiment the free end 32 of the track line 24 is secured to the reduced diameter portion 48 of the shaft 18. In this manner, the three end 32 of the tracking line 24 may be tied securely and knotted, the notches or threading providing support of the shaft. The arrow head 20 is then secured over the reduced diameter portion 48 of the shaft 18, so to enclose securely the free end 30 of the tracking line 24 and to enclose knots or excess line depending therefrom. Thus, the tracking line 24 is secured fixedly and cannot slide along the length of the arrow shaft or become separated therefrom.

It is to be appreciated from the foregoing that there has been provided herein a game tracking device for use in combination with archery equipment wherein a game tracking line is secured, at a free end thereof to an arrow and is paid out of a canister mounted proximate the mid-point of a bow, disposed laterally thereof, outside of the line of sight of an archer. It is further to be understood that the present invention is amenable to a variety of modifications and adaptations all falling within scope and spirit thereof.

Having thus described the invention, what is claimed is:

1. A game tracking device for use in combination with a bow, comprising:

a tracking line, the tracking line being center wound into a spool such that the tracking line pays out from the center of the spool, a container for housing and paying out the tracking line, the container comprising a first end and a second open end for removably and replaceably receiving the spool of tracking line, the container further including a cover removably mounted onto and adapted to fit securely over the second end of the container, the cover being provided with an aperture through which the tracking line is paid out;

a mounting bracket connected to a first end of the container and adapted to mount the container to a bow at a point laterally removed from the bow, and wherein the tracking line is adapted to be coupled at a first end thereof to an arrow such that when an arrow is launched from a bow and tracking line is drawn from the container to track the position of an arrow.

2. The game tracking device of claim 1 wherein the mounting bracket is provided with a mounting plate having means disposed thereon for receiving mounting implements for mounting the mounting plate to the bow.

3. The game tracking device of claim 1 wherein the tracking line is coated with a luminescent coating to permit the line to glow in the dark.

* * * * *